US005279341A

United States Patent [19]

Schirmacher

[11] Patent Number: 5,279,341

[45] Date of Patent: Jan. 18, 1994

[54] FILLING DEVICE

[75] Inventor: Manfred Schirmacher, Berkamen-Overberge, Fed. Rep. of Germany

[73] Assignee: Schering Aktiengesellschaft, Bergkamen, Fed. Rep. of Germany

[21] Appl. No.: 977,603

[22] Filed: Nov. 17, 1992

Related U.S. Application Data

[62] Division of Ser. No. 674,377, Apr. 15, 1991, Pat. No. 5,186,224.

[30] Foreign Application Priority Data

Oct. 26, 1988 [DE] Fed. Rep. of Germany ..... 3836365

[51] Int. Cl.[5] ..... B67D 5/32

[52] U.S. Cl. ..... 141/387; 141/59; 141/207; 141/383; 141/346; 141/384; 137/588

[58] Field of Search ..... 141/206-211, 141/217-219, 227, 228, 59, 311 R, 301, 302, 305, 346, 290-296, 382-389; 340/686, 687; 137/588, 798; 251/144; 285/119

[56] References Cited

U.S. PATENT DOCUMENTS

| | | | |
|---|---|---|---|
| 749,633 | 1/1904 | Seeley | 340/687 X |
| 3,596,810 | 8/1971 | Taubenheim | 222/400.7 |
| 3,640,320 | 1/1970 | Elkuch | 141/59 |
| 3,786,207 | 1/1974 | Houston et al. | 141/207 X |
| 4,143,689 | 3/1979 | Conley et al. | 141/207 |

*Primary Examiner*—J. Casimer Jacyna
*Attorney, Agent, or Firm*—Scully, Scott, Murphy & Presser

[57] ABSTRACT

A filling device for transportable containers and other suitable receptacles for the receipt of liquids, which facilitate a reliable and particularly feasible indication of faulty conditions encountered during operation in consideration of the handling thereof. A valve which closes off a filling tube of the container is actuated in dependence upon the connecting conditions of the filling device to the container; such as a tank container. When the filling device is not adequately coupled with an inlet pipe or any other device of the tank container, flow of liquid filling material cannot be initiated inasmuch as this flow is positively inhibited by the valve. Pursuant to another aspect, a vent or relief valve is automatically actuated in dependence upon the connected condition. The vent valve is also only first opened then when there has taken place a satisfactory or proper coupling with the respective tank container. This is of considerable significance for exhaust gas or, in essence, exhaust air removal installations, whose pipeline network continually stands under a certain subatmospheric pressure. Furthermore, there is a provision for an external display and plotting of a correct connection, as well for the operation of a sensor indicative of the filling condition which is present.

8 Claims, 4 Drawing Sheets

FILLING DEVICE

This is a divisional of copending application Ser. No. 07/674,377, filed on Apr. 15, 1991, now U.S. Pat. No. 5,186,224.

BACKGROUND OF THE INVENTION

1. Field of the Invention

The present invention relates to a filling device for the filling of a tank container or the like receptacle.

Filling devices for the filling of transportable containers are known per se in the most differing configurations. For example, they are connected through the intermediary of a flexible connecting conduit to a stationary supply line, and are accessible to a manual guidance or; in essence, handling thereof. In accordance with the type of the applicable liquid filling material, especially in view of the extent of any endangerment of the environment and possible harmful effects emanating therefrom, there must be met special safety precautions and other measures in order to prevent any uncontrolled discharge of the liquid filling material from the mentioned lines into the surroundings, and to thereby prevent any adverse influences on the environment which originate from the filling procedure. For instance, the last mentioned procedure pertains to a controlled evacuation of exhaust air or, essentially, exhaust gases which are encountered during the filling of a container, for example, by means of an exhaust gas removal installation which is continually under a certain sub-atmospheric pressure or vacuum. An uncontrolled discharge of the liquid filling material into the surroundings can be encountered in a multiplicity of forms as a consequence of faulty handling or also because of an improper condition in the connection of the filling device with the associated container.

The heretofore known filling devices can be viewed as being inadequately operationally dependable and are not adapted to be able to eliminate the risks which originate as the result of human error. Moreover, as in the instance of the presently known overflow-protective device, there are frequently dealt with only partial aspects of the safety problems which are encountered during the handling of liquids which endanger the environment, especially during the filling of transportable containers.

2. Discussion of the Prior Art

Thus, from the disclosure of U.S. Pat. No. 2,348,478 there has become known a filling device for liquefied gas for a stationary tank container, which is designed for cooperation with a pipe connector arranged in the tank container wall and serves for filling purposes, and which concurrently contains a conduit for the discharge for vapor displaced from the tank container during the filling thereof. The filling device can be screwed onto the above-mentioned pipe connector; and for the vapor discharge as well as for the liquid line there are provided mutually separate valves which are automatically actuatable through the threaded movement, and whose opening condition will only first take place subsequent to the reaching of an orderly or proper threaded connection. The mentioned vapor lien and the liquid line are arranged so as to extend coaxially within each other, and there are presently provided, on the one hand, paired valve portions in a flexible connecting line and, on the other hand, within the pipe connector which, when actuated by pushers, are opened during the threaded engagement of the connecting line together with the pipe connector opposite the force of resetting springs, by the latter of which both valves of a valve pair are otherwise maintained in their closed condition. The flexible connecting line is designed for cooperation with a tank vehicle, and at its end towards the vehicle possesses comparable paired valves, such that during the filling of liquefied gas into the stationary tank container, the tank of the tank vehicle will absorb vapor which is displaced from the stationary tank container. Consequently, this known filling device is exclusively designed for cooperation with correspondingly equipped tank vehicles. In view of the paired valve constructions, it is relatively complicated in its arrangement.

From the disclosure of U.S. Pat. No. 1,911,987 there has become known a filling device for fuel which is designed for cooperation with the tank of a motor vehicle. This contains a valve influencing the flow of fuel which, as a result of a proper insertion into a filling connector which stands in communication with the wall of the tank container is then opened, whereby the filling device in the inserted position is secured in a close fit by an electro-mechanically actuated locking lever, a slider or the like. Through the intermediary of an electrical switch, whose actuation is dependent upon the position of a filling condition sensor, the mentioned slider, locking lever or the like is conducted into an unlatched position, as a result of which the filling device is ejected from the pipe connector under the action of a spring force, and the mentioned valve is closed. A vent line is not provided in this known filling device. The mentioned switch merely serves to act in a current circuit which is responsive to the filling condition and the orderly insertion of the filling device, and is not available for superordinated control tasks.

Finally, from the disclosure of U.S. Pat. No. 3,880,214 there has become known a further filling device for the tank container of a motor vehicle, which contains a spring-biased valve opening the flow of fuel in the case of the proper insertion into the filling connector of the tank container. Through the intermediary of a vent line, in a known manner, upon reaching of a maximum filling condition for the tank container, there is interrupted any further flow of fuel. The mentioned vent lien does not possess an automatically actuatable valve in the filling device. Moreover, the switching motions which are required for the actuation of the fuel valve are not obtained from screw-type or threaded movements, but from a pure plug-inserting movement of a key-like element into a receiver provided for this purpose.

SUMMARY OF THE INVENTION

Accordingly, it is the object of the present invention to construct a filling device of the above-considered type in such a manner that in a simple and economical manner, there is facilitated an assured, and particularly feasible indication of faulty conditions during operation in consideration of the handling thereof. This object is attained with a filling device of the type considered herein through the features as set forth in the specification in more specific detail hereinbelow.

Hereby, it is an important aspect of the invention that a valve which closes off the filling tube is actuated in dependence upon the connecting conditions of the filling device to a container; for example, such as a tank container. In the case, in which the filling device is thus not adequately coupled with the inlet pipe or any other device of the tank container, flow of liquid filling material cannot be initiated inasmuch as this flow is positively inhibited by the above-mentioned valve. For instance, the filling device forms the end element of a flexible conduit; for example, such as a hose which, in turn, is connected to a stationary filling installation at the end point of which there are arranged counters, shutoff valves or the like. By means of the above-mentioned valve there is concurrently prevented that in the presence of a filling device which is loosened from a tank container, the residual quantity of liquid which is present in the flexible conduit will discharge in an uncontrolled manner; in essence, that the mentioned conduit will thus empty itself. With the inventive filling device, any indications of human errors which cause an unintended initiation of a filling procedure, will not result in any damaging effects. The constructive configuration of the valve, especially its operational interconnection with the fastening of the filling device to the closure opening of the tank container can basically be constructed in any suitable manner. To that extent it is merely important that the valve should only first open after there has taken place a reliable coupling between the filling device and the tank container.

In accordance with another aspect of the invention, the inventive filling device also incorporates a vent or relief valve which is automatically actuated in dependence upon the connected condition. Hereby, the vent valve is also only first opened then when there has taken place a satisfactory or proper coupling with the respective tank container. This viewpoint is of considerable significance for exhaust gas or, in essence, exhaust air removal installations, whose pipeline network continually stands under a certain subatmospheric pressure. Inasmuch as the vent valve will open only first after the coupling with the tank container has been effectuated; there is prevented any unnecessary aspiration of infiltrated air, so that the exhaust gas quantity which must be removed is limited to the quantity of gas which is actually displaced from the respective tank container as a consequence of the filling procedure. Through this kind of actuation of the vent valve there is in a significant manner assisted the economical operation of an exhaust gas removal installation. In this manner, the inventive filling device is especially adapted for an economical operation of large automatically-operated filling installations incorporating exhaust air removal devices. For gas compensation operation the unauthorized entry of external air or; in essence, discharge of gas, is similarly restricted to a minimum extent.

Finally, in accordance with a further feature of the invention, there can also be provided a switch which is similarly activated in response to the connected condition of the filling device. This switch can basically generate an electrical signal; however, also a pneumatic or other suitable output signal which indicates the connected condition of the filling device, and is employed for the internal and external control procedures and interlockings which are necessary within a filling installation. For example, in this manner there can be prevented in the case of an irregular coupling of the connecting device to the tank container, that this could lead to a pressure build-up in the respective flexible connecting conduit. However, the switch can also be integrated in any suitable manner into more complex monitoring systems for whose operation there is required, or expedient, the presence of a signal which indicates the connected condition of the filling device.

Pursuant to the inventive concept, for the actuation of the above-mentioned valve as well as the switching movement required for the switch, this is obtained from the relative axial movement between two sleeve components which are guided coaxially within each other, of which one component stands in fixed connection with the filling pipe.

The sliding movement between the sleeve components is initiated through a screw coupling procedure which is implemented; for example, by means of an coupling nut which externally engages about one of the two sleeve components, whereby the coupling nut is screwed together with a pipe connector which covers over the bung hole of a tank container. Accordingly, there are derived the switching movements from the axial displacement of the sleeve components relative to each other which correspond to a specified screwthreaded coupling.

In accordance with another inventive aspect, the vent valve is structurally combined with the above-mentioned sleeve components, as a result of which there is obtained a particularly simple construction. The sleeve components are elastically fixed in their axial position relative to each other by means of a spring element, and with regard to their end facing towards the tank container are constructed so as to be open. The filling pipe which penetrates through the sleeve components hereby takes up merely a portion of the cross-section of the sleeve components. Connected to an exhaust gas pipeline section which attaches to the bores in the respective outer sleeve component, there can again be, in turn, a flexible conduit; for instance, a hose, which itself forms the connecting element with an automatically-operating filling installation incorporating an exhaust gas removal installation.

Other details of the invention are directed to a simple constructive conversion of the switching movement of the sleeve components for the actuation of the valve which is located at the outlet of the filling pipe. The operating rod at this location represents a mechanically extremely simple and quite sturdy structural component for transmitting this switching movement.

The actuation of the switch can be carried out in an especially simple manner through an actuating pin, whereby the actual switch is positioned in such a manner that the pin transmits the movement of the sleeve components relative each other, and namely such, that upon reliable screwthreaded coupling together of the filling device with the above-mentioned pipe connector, the switch is conducted into a switched position which indicates this operating condition. Basically, however, there can be employed other switching principles; for example, through valves and mechanical or non-contacting switches. Merely essential is the aspect that there is given a clear recognizability of the condition of being screwed together and that this is convertible in conformance with the switching technology.

Finally, in accordance with the features of the inventive, a filling condition sensor can also be structurally integrated into the filling device. The signal which is generated by the filling device at the output end, and which indicates the filling condition of the respective tank container can, in turn, be again employed in a suitable manner in a super ordinated measuring and monitoring system.

BRIEF DESCRIPTION OF THE DRAWINGS

The invention is now more closely elucidated hereinbelow, with reference to the exemplary embodiments illustrated in the drawings. As is illustrated.

DETAILED DESCRIPTION OF PREFERRED EMBODIMENTS

Figure 1:
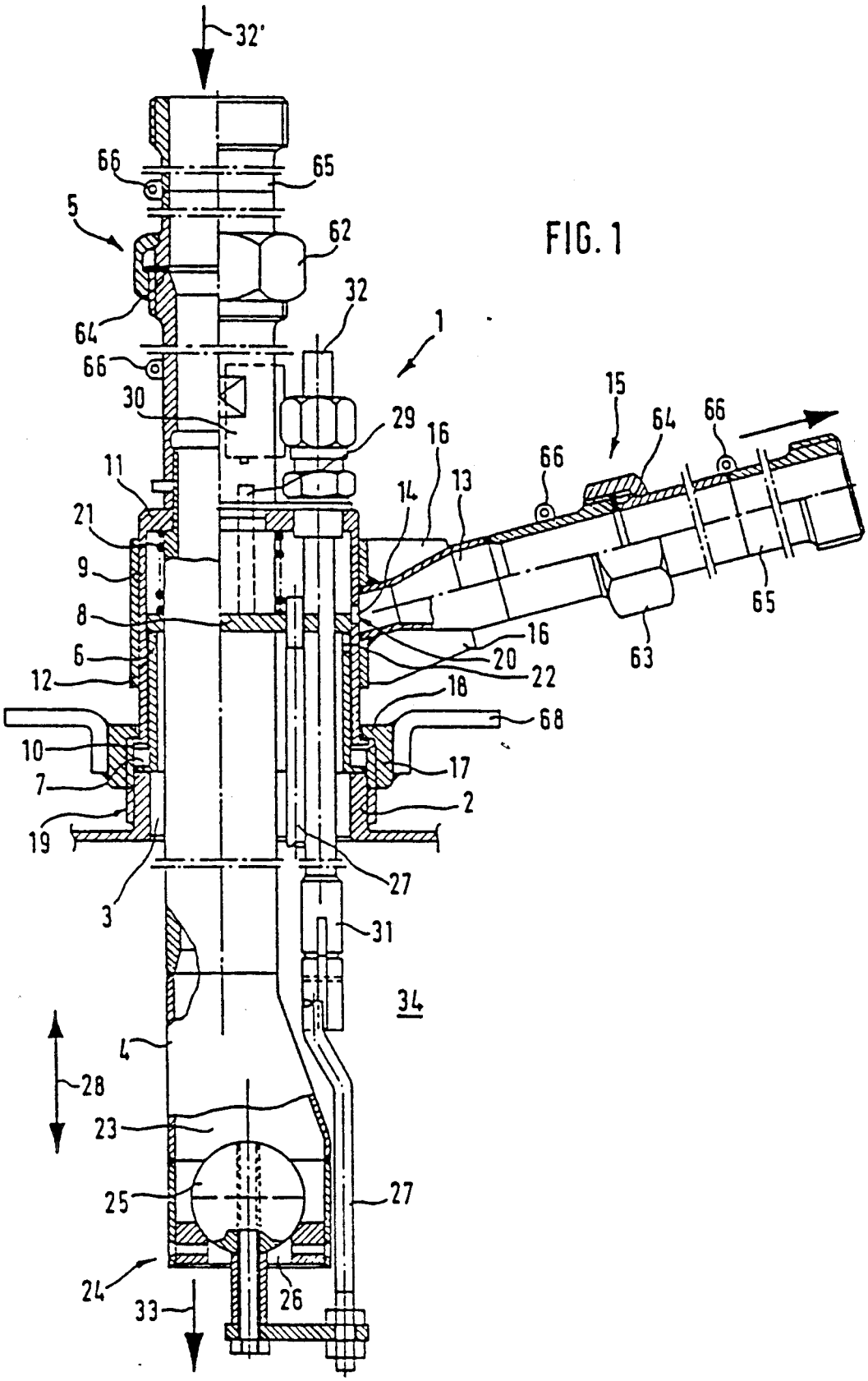
FIG. 1 illustrates, on an enlarged scale, a representation of an inventive filling device shown in section.

Identified by reference numeral 1 in FIG. 1 is the filling device in its entirety. In the illustrated representation, the device is screwed onto the pipe connector 2 of the bung hole or filling aperture 3 of a tank container which, for the remainder, is not illustrated. It possesses a tubular base member or, in effect, filling tube 4 which serves for the conveyance of a liquid medium, which has one end thereof extending into the tank container and at its other end equipped with connector fittings which, in their entirety, are designated by reference numeral 5, and which serve for the insulated (FIG. 4) coupling of a connecting hose, pipe or the like.

The filling pipe 4 is inserted into a sleeve component 6 which, on the end thereof towards the pipe connector 2 is equipped with a radially outwardly extending annular flange 7 which is determined for application onto the pipe connector 2. The sleeve component 6 is closed off at the end thereof which is distant from the annular flange 7 by a bottom portion 8, the latter of which is pierced through by the filling pipe 4. The bottom portion 8 is constructed as a flat plate.

A further sleeve component is identified by reference numeral 9, which coaxially encompasses the sleeve component 6 and is slidably arranged relative to the latter. The sleeve component 9, at the end thereof towards the filling aperture 3 is equipped with an annular flange 10, and at its other end is closed off by a bottom part into which there is sealingly inserted the filling tube 4.

Identified by 12 is a reinforcing ring exteriorly encompassing and contacting against the sleeve component 9, and which serves for the attachment of an exhaust gas pipe 13. The end of the exhaust pipe 13 towards the filling device 1 is welded into an opening provided in the reinforcing ring 12, whereby the last-mentioned opening provided in itself extends over a plurality of bores 14 which are formed in the wall of the sleeve component 9. With regard to the significance of these bores 14 further detail is provided hereinbelow: The exhaust gas pipe 13 is, in turn, again equipped with insulated connector fittings, which are designated herein in their entirety by reference numeral 15. These connector fitting armatures 15 serve for the insulated coupling of a flexible conduit, a hose, a pipeline or the like, in accordance with FIG. 4. In the utilization pursuant to FIGS. 2, 3, 5 and 6, these connector fittings 5, 15 can be omitted when there is not implemented any electrical line monitoring.

With reference numeral 16 there are identified web plates which serve for the stabilizing of the position of the exhaust gas pipe 13 and which, by means of welds, stand in connection with the exhaust gas pipe 13 as well as with the reinforcing ring 12.

A collar or coupling nut 17 which encompasses the exterior of the sleeve component 9 is at one end thereof equipped with a radially inwardly projecting flange 18 which is intended to engage for over the annular flange 10, and which is screwed onto the external screwthread 19 on the pipe connector 2. In order to simplify the manual actuation, the coupling nut 17 is equipped with a series of herein diagrammatically shown handgrips 68 or the like, which are welded to the outside of the coupling nut 17.

Identified with reference numeral 21 is a helical spring which encompasses the exterior of the filling tube 4, on the one hand, supported against the bottom part 8 of the sleeve component 6 and, on the other end, supported against the bottom part 11 of the sleeve component 9, by means of which the annular flange 10 is elastically pressed under mechanical prestressing against the flange 18. Through either the tightening or loosening of the coupling nut 17, the helical spring 21 is resultingly either stressed or relieved of stress.

Reference numeral 22 designates a few bores which are arranged in the sidewall structure of the sleeve component 6, which are provided in proximity to the bottom part 8. The bores 22 correspond in their dimensions to the bores 14 and are arranged relative to the latter in such a manner that due to an axial displacement of the sleeve component 9 relative to the sleeve component 6, the bores 14 and 22 can be brought into a mutually aligned arrangement. The bores 14, 22 in connection with the applicable sections of the sleeve components 6, 9 form a vent or relief valve 20, concerning which discussion is made hereinbelow in further detail.

The filling tube 4, at the end thereof towards the tank container, possesses an enlarged section 23 whose end towards the interior of the tank is closed off by means of a valve 24.

The valve 24 possesses a spherical blocking member 25 which closes a discharge opening 26 and to which there is fastened an actuating rod 27. The actuating rod 27 extends essentially in parallel with the longitudinal axis of the base member 4 and has its end fastened in the bottom part 8 the sleeve component 9. From the foregoing, it is recognizable that a tightening or, respectively, loosening of the coupling nut 17 has as the result of relative movements of the sleeve component 9 with respect to the sleeve component 6 in the direction of the arrows 28, as a consequence of which the discharge opening 26 is either opened or closed through a corresponding movement of the blocking member 25.

Designated by 29 is an actuating pin which is arranged on the side of the bottom part 8 which is distant from the filling aperture 3, and which cooperates with a switch 30, and essentially in such a manner that due to the movement of the bottom part 8 and thereby that of the pin 29 in the direction towards the switch 30, by means of the latter there is implemented a switching function. The extent of displacement of the pin 29 which is associated with this switching function is dimensioned such that this switching function, the significance of which is discussed hereinbelow, is only then initiated when, due to a sufficient tightening of the coupling nut 17 there has been effectuated a reliable screwthreaded connection of the filling device with the tank container. The switch 30 thereby signals the satisfactory, in particular operationally-reliable coupling of the filling device to the tank container and, for this purpose, is equipped with signal lines which, however, are not represented in FIG. 1 due to reasons of illustrative clarity. Finally, designated by reference numeral 31 is a filling condition sensor which is sealingly screwed into the bottom part 11, and which can basrcally be based on suitable; for example, electrical or pneumatic operating principles. The head portion 32 of this filling condition sensor 31 is equipped with applicable signal lines which, however, are similarly not illustrated in FIG. 1. For an electrical monitoring, the insulator-coupling nuts 62, 63, the seal 64, and the metallic contacts 65 with the connecting eyelets 66 welded thereto serve as the signal line.

From the foregoing representation it is possible to recognize that the inventive filling device distinguishes itself through a series of special safety precautions, as a result of which there can be avoided, to a considerable event, harmful effects which are caused in consequence of faulty handling or other malfunctions. The liquid which enters the filling device in the direction of the arrow 32' can only first exit therefrom when there has been formed a reliable screw connection by means of the coupling nut 17, as a result of which the valve 24 frees the discharge opening 26 so that the liquid can flow into the tank container in the direction of the arrow 33. On the other hand, the already previously mentioned vent valve 20 which is formed by the bores 14, 22 is not opened prior to the formation of this threaded connection. Finally, a further signal which is obtained from the threaded connection can be conducted further by means of the switch 30 to external control devices. An insufficient threaded connection is thereby recognized by means of the switch 30 and, through of control technology, can be already utilized within a filling installation for the termination of a product flow. The filling device 1 represents the end element; for example, of a flexible metal hose which, in turn, has again associated therewith a counter as well as a shut-off valve. This means that the interior space of the filling pipe 4 can be already filled with liquid prior to the threaded connection with the pipe connector of the filling aperture. An uncontrolled discharge of the liquid from the filling pipe; however, is prevented by the valve 24. The comparable situation is applicable during the disassembly of the filling device 1 from a tank container, in that by means of the filling condition sensor 31 there has been signaled the maximum permissible level within the tank container. A loosening of the coupling nut 17 hereby provides the result of an immediate closure of the valve 24, so as not to encounter any danger of an uncontrolled discharge of the residual quantity of liquid which is contained in the filling pipe as well as in the metal hose which is connected with the connector fittings 5.

Hereinbelow, with reference to the illustrative representation of FIGS. 2 through 6, there is explained the manner in which the inventive filling device 1 cooperates with other operating elements which serve for the secure handling of liquids. Hereby, the operating elements which coincide with those in FIG. 1 are also coincidingly numbered, such that a repeated description thereof is rendered unnecessary.

Figure 2:
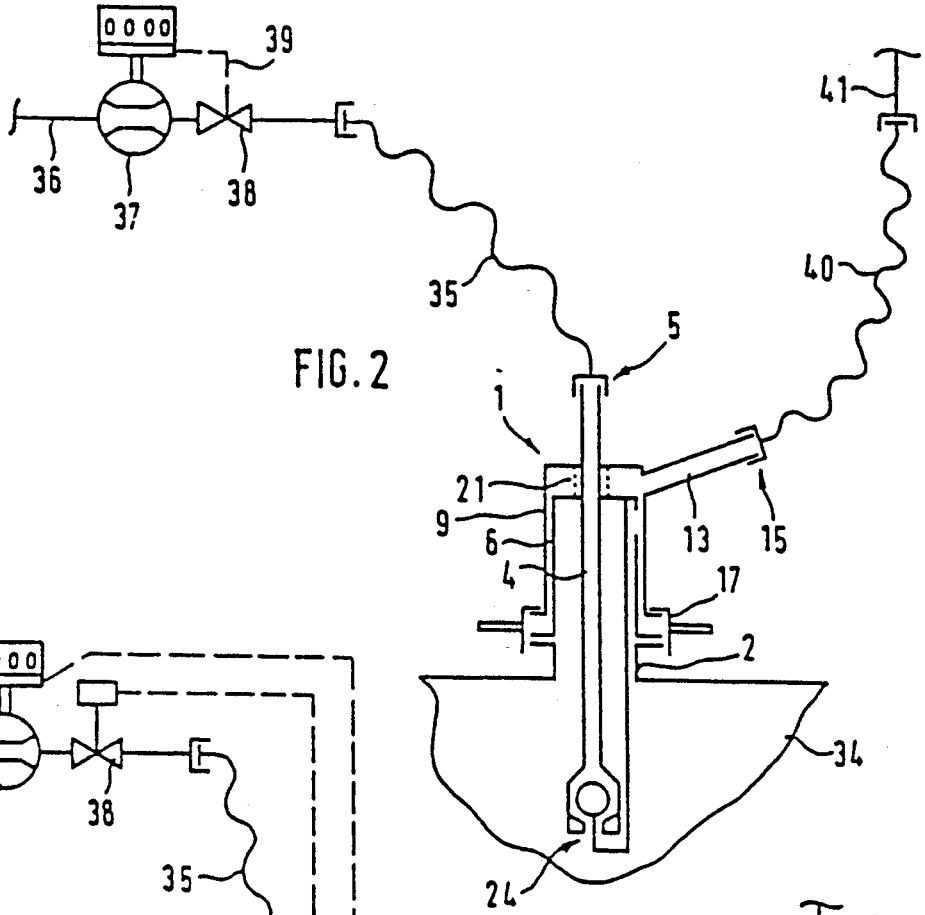
FIG. 2 illustrates a first instance of utilization of the filling device.

FIG. 2 illustrates a filling device 1 which is screwed onto the pipe connector 2 of a tank container 34. A flexible conduit 35 connects the connector fitting 5 of the filling pipe 4 with; for example, a stationary feed conduit 36, at the end point of which there are arranged a counter 37 as well as a quick-acting valve 38 or some other shut-off element, which is actuatable by means of the counter 37. The last-mentioned operative connection is indicated through the phantom-line 39.

Basically, the counter 37 is constructed in a manner such that a defined liquid quantity can be set thereby after the through-passage of which there is automatically actuated the rapid-action valve 38.

Through numeral 40 there is identified a further flexible conduit which is connected to the connector fitting 15 for the exhaust gas conduit 13 and to, for example, a stationary exhaust gas removal installation 41, herein illustrated only by phantom-lines in the drawings. The exhaust gas removal installation 41 can be constructed in the usual manner so that within the conduit 40 there reigns a specified sub-atmospheric pressure.

In order to initiate the filling procedure for the tank container 34, then through the conduits 40, 35 the filling device 1 which is attached to the feed conduit 36 and to the exhaust gas removal installation 41, is mounted on the pipe connector 2 and then screwed thereto by means of the coupling nut 17. As soon as there has been attained an adequate threaded connection, which is signaled through an applicable displacement of the sleeve part 9 relative to the interior sleeve component 6, there is produced an opening of the valve 24 as well as the above-described vent valve which is associated with the exhaust gas conduit 13. Thereafter, the desired quantity of liquid is set on the counter 37 and the filling procedure is initiated through opening of the rapid-action valve 38. The filling sequence is terminated as soon as there has been reached on the counter 37 the set quantity of liquid which is to be introduced into the tank container 34. As a consequence of the subsequent loosening of the coupling nut 17, the valve 24 and the mentioned vent valve are automatically closed. The residual quantity of liquid which remains in the conduit 35 as well as in the filling pipe can thereby no longer exit in an uncontrolled manner. Due to the now closed vent conduit, the exhaust gas removal installation is no longer subjected to the excess suctioning of air, so that the quantity of exhaust air which is to be removed is positively limited to a necessary minimal volume.

Figure 3:
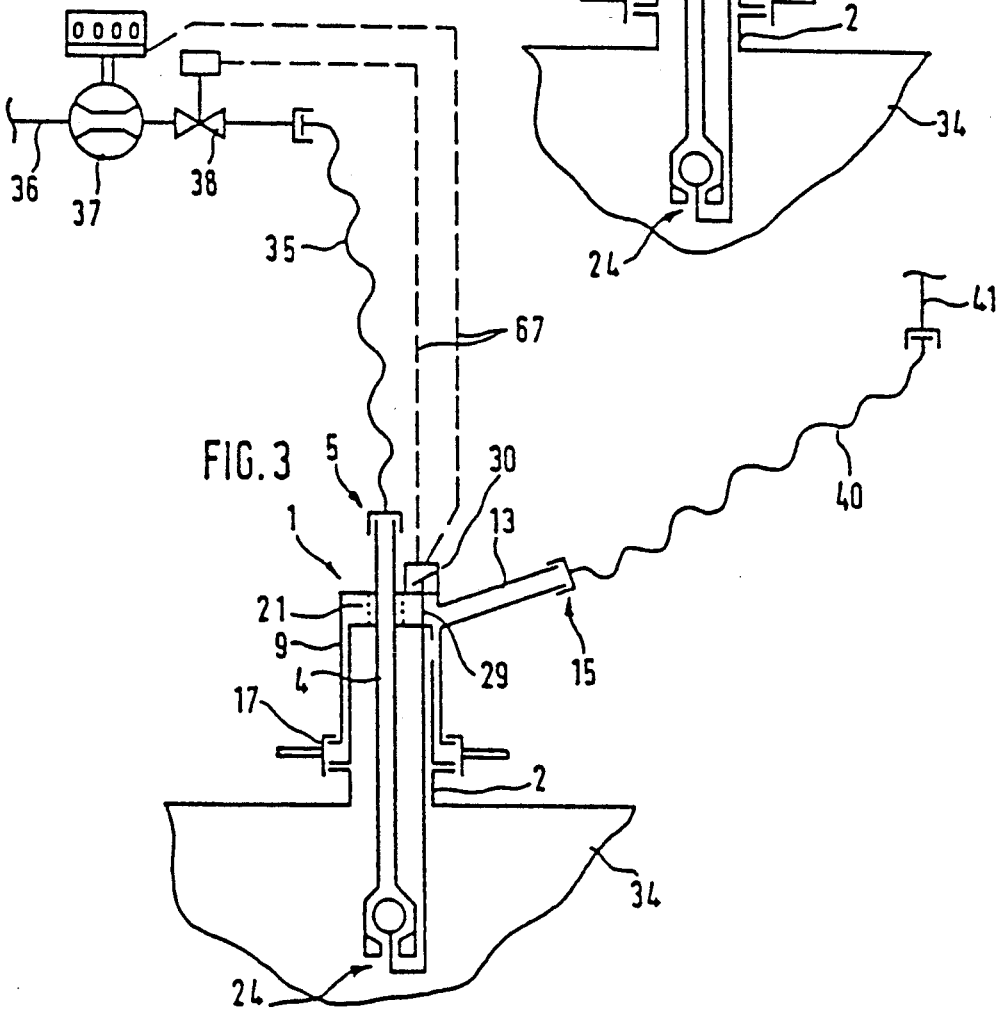
FIG. 3 illustrates a further example of utilization of the filling device.

The exemplary embodiment which is illustrated in FIG. 3 essentially distinguishes itself from that in FIG. 2, in that in this case the switch 30 is presently in an operative connection with the rapid-acting valve 38 by means of the signal lines 67, so that an initiation of the filling procedure through an opening of the rapid-action valve 38 by means of the actuating device which is arranged on the counter 37, is prevented for as long as the filling device is not adequately screwed together with the pipe connector 2. In this manner there is avoided a pressure build-up in the conduit 35 at an improper connection of the filling device. For the remainder, the rapid-action valve 38, quantity of liquid reaching that which is set on the counter 37, is automatically switched off by the latter. The mode of functioning of the valve 24 as well as that of the vent valve corresponds with that in the embodiment pursuant to FIG. 2.

Figure 4:
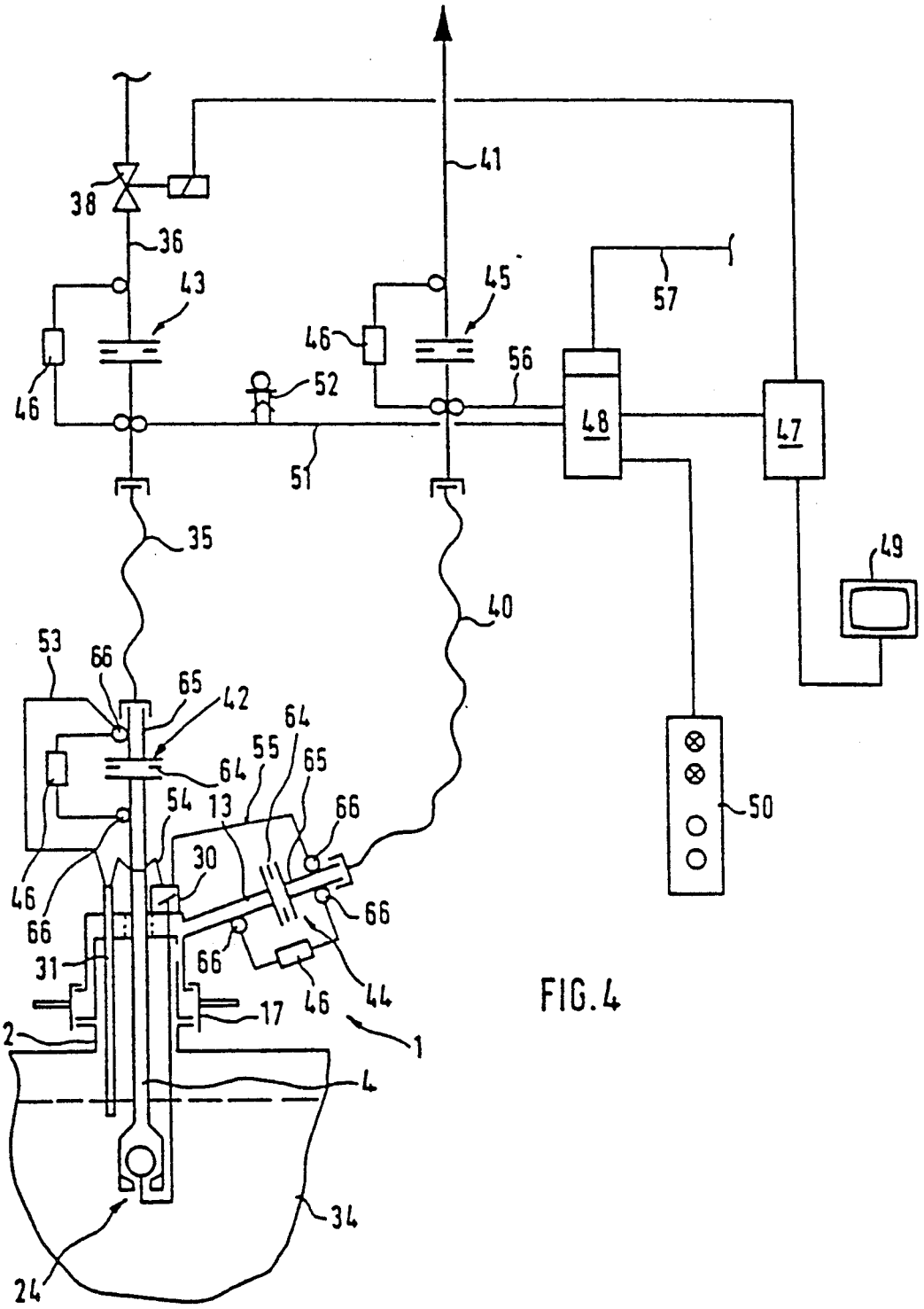
FIG. 4 illustrates an exemplary utilization of the filling device with a filling condition sensor and monitoring capability for the pipeline condition.

FIG. 4 illustrates an exemplary embodiment in which the filling device is equipped with a filling condition sensor 31, and is integrated into an installation in which there are additionally provided special protective precautionary measures with regard to encountered static electricity, as well as any possible defective conduits 35, 40.

The conduit 35 is connected at both ends thereof through electrically-insulated screw and flange connections 42, 43 to respectively, the filling pipe 4 and the supply line 36. The conduit 40 is connected, at the one end, through further electrically-insulated screw and flange connections 44, 45 to the exhaust gas conduit 13 and, at the other end to the exhaust gas removal installation 41. The conduit 35 as well as the conduit 40 are, in a manner known per se, constructed so as to be electrically conductive.

With numeral 46 there are merely identified impedances or resistances through which the flange connections 42 through 45 are electrically bridged over so as to prevent an occurrence of any local electrostatic electricity.

Through 47 there is indicated a control device which, in a manner still to be so described, is in operative connection with a monitoring device 48, a display apparatus 49 and the rapid-action valve 38 or any kind of suitable closure element.

Through 50 there is finally identified an actuating apparatus which is in operative connection with the monitoring device.

From the monitoring device 48 an electrical line section 51 leads through an emergency switch 52, the conduit 35, an electrical line 53, the filling condition sensor 31, an electrical line 54, the switch 30, a further electrical line 55, the conduit 40 and a line section 56, back to the monitoring device 48, by means of which this current circuit is completed.

Numeral 57 finally designates a connection to an electrical power supply to which there is connected the monitoring device 48.

The filling condition sensor 31 hereby evidences a known cold conductor as a measuring probe, whose functioning principle is based on a change in the resistance upon immersion into a cold liquid. For the monitoring of the filling condition, a specific voltage is thereby impressed on this last-mentioned current circuit whereby in dependence upon the impedance; in essence, the conductivity of the current circuit, there is encountered a specific current from whose measurement there can be derived the recognition of malfunctions or disruptions.

For the employment of this filling device 1 constructed pursuant to FIG. 4, as already described hereinabove, this is initially screwed together through the intermediary of the coupling nut 17 with the pipe connector 2 of the tank container 34 in such a manner, that the valve 24 as well as the vent valve which is associated the vent conduit 13 can be readily opened. Together with the screw connection there is also concurrently associated a closing of the switch 30. During the filling procedure which is initiated through the actuating apparatus 50, by means of the monitoring device 48 on the basis of the above-described current circuit there is initially tested the condition of the connecting conduits as well as the filling condition of the tank container 34. For this purpose, measured during a specified time interval is the conductivity or, in essence, the impedance within the mentioned current circuit. When, for example, one of the conduits 35, 40 is defective, possibly due to the presence of a break or some damage, this is immediately recognized on the basis of the resistance or impedance measurement. For instance, when there is still no presence of any reliable threaded connection, this is similarly also immediately recognized in view of the open switch 30. Finally, if the filling device 1 is inadvertently screwed onto an already filled tank container, and namely in such a manner that the cold conductor-measuring probe of the filling condition sensor dips into the liquid, then this is also immediately recognized by means of the monitoring device. In all of these disruptive instances is there transmitted a suitable signal to the control arrangement 47, so that notwithstanding of the initiation of the filling procedure through the actuating apparatus 50, there is inhibited a corresponding opening of the rapid-action valve 38. Consequently, prior to the initiation of the filling procedure, a safety investigation takes place with regard to the interconnecting of the filling device with the tank container 34, as well as also with regard to the condition of the conduit which extend therebetween, whereby in each one of the mentioned cases of disruption, there is already avoided any pressure build-up in the conduit 35. The display apparatus 49 which; for example, can be the monitor of an EDP installation, serves for the display of disruptions or; in essence, the switched conditions of the herein represented installation.

It is ascertainable from the above-mentioned representation that the inventive filling device 1 affords a particular property for its integration into more complex safety or; in essence, monitoring systems, and thereby is particularly adapted for the handling of environment contaminating liquids; for example, water-contaminating, combustible liquid mixtures, acids, solvents or the like, with regard to which there must be prevented any uncontrolled discharge from pipeline systems.

Figure 5:
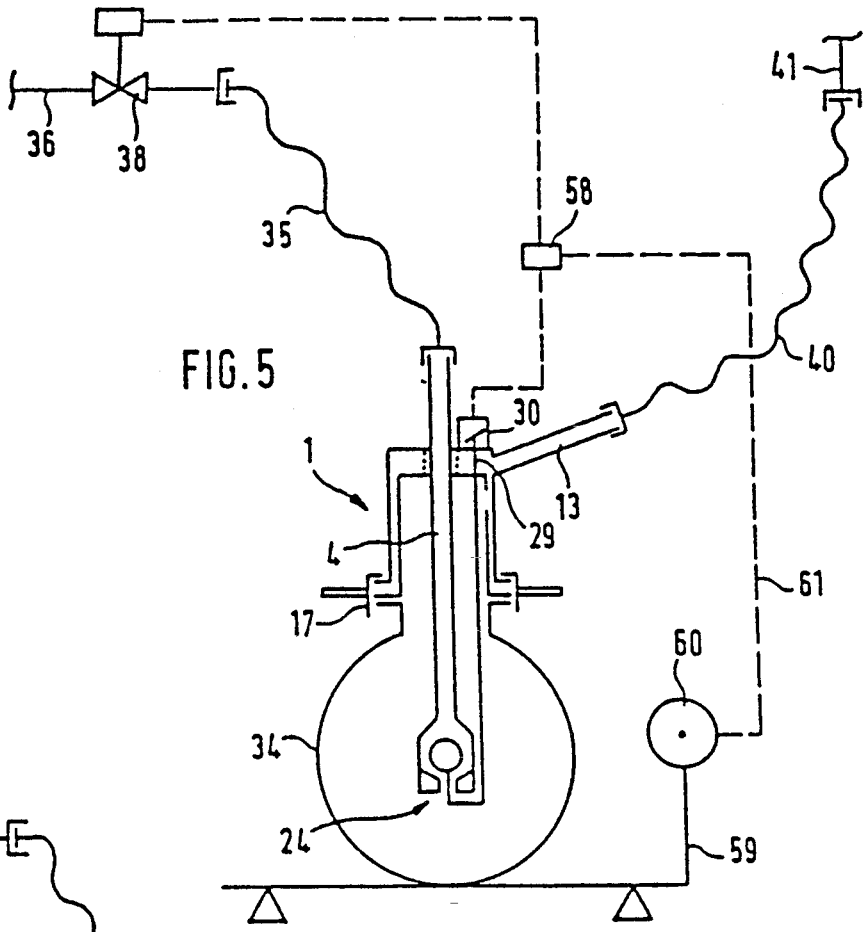
FIG. 5 illustrates an example in the utilization of a filling device in connection with a scale which is associated with a tank container.

FIG. 5 illustrates an exemplary embodiment in which a valve is actuated by means of the switch 30 which is integrated into the filling device 1, and through which in a pneumatic function there is transmitted a signal to a control device 58, which signal signifies the threaded condition of the coupling nut 17. The junction of the switch 30 with the control arrangement 58, however, can also be basically effected through other types of signal transmitter.

The tank container 34 is mounted on a scale 59, on the control unit 60 of which there can be set the theoretical quantity of a liquid filling material which is to be introduced into the tank container 34. When this theoretical quantity is reached, then through the line 61 there is conducted a suitable signal to the control arrangement 58. Accordingly, in the exemplary embodiment pursuant to FIG. 5, there is facilitated a gravimetrically prescribed filling of liquid filling material into a tank container 34, or into any other kind of receptacle. The filling procedure is initiated by means of the control arrangement 58, whereby it will only lead to an activation of the rapid-action valve 38 or, in essence, the blocking components which are located therein, when there is evident a reliable threaded connection of the coupling nut 17, as a result of which the valve 24 as well as the vent valve which is arranged in the exhaust gas conduit 13 are again opened. The last-mentioned opening sequence, however, only takes place when there is not signaled through the line 61 the reaching of the set theoretical quantity or the presence of any other boundary magnitude.

Figure 6:
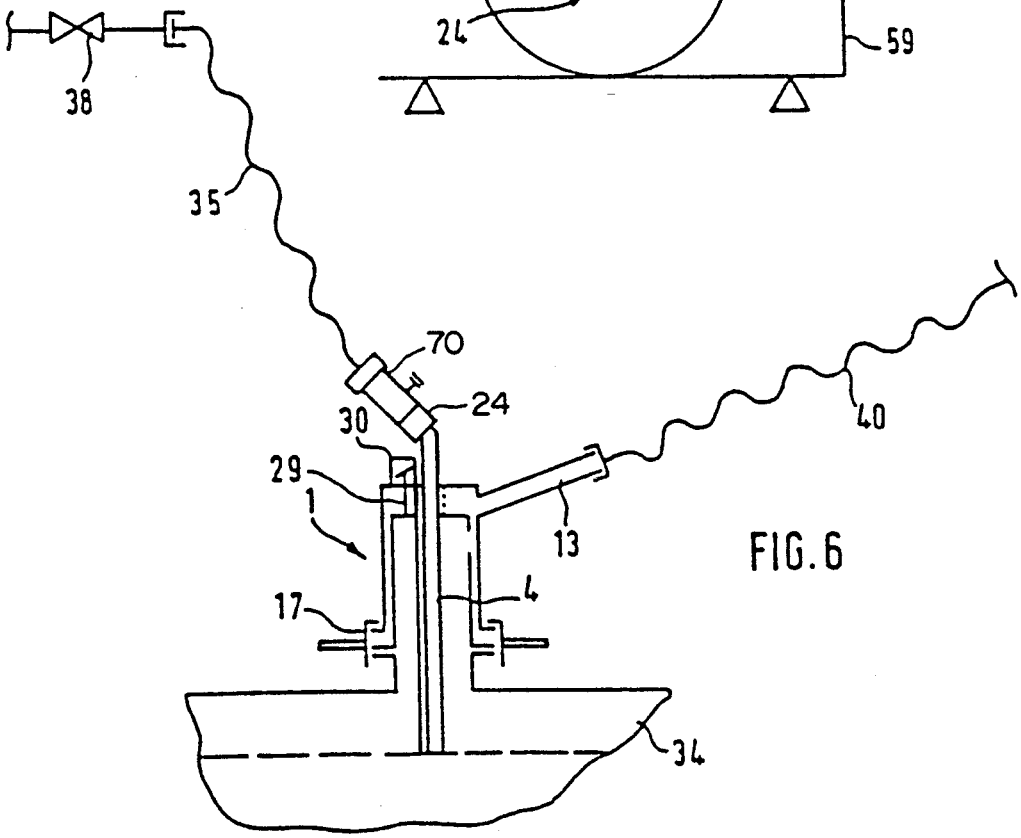
FIG. 6 illustrates an example in the utilization of structurally integrated pistol-grip dispensing nozzle.

Finally, in FIG. 6 there is disclosed a exemplary embodiment of a filling device which again contains the valve 24 at the lower end of a filling pipe 4 shaped at its upper end as a pistol-grip filling nozzle pursuant to the preceding exemplary embodiments, whereby the latching through the actuating pin 29 acts now directly mechanically or through a switch 30 on the actuation of the pistol-grip 70 of the filling nozzle. In the presence of a coupling nut 17 which is not properly tightened, an actuation of the filling nozzle is consequently ineffective. The functional interconnection in the movement of the coupling nut with the actuating mechanism of the pistol-grip filling nozzle can be basically implemented in any suitable manner.

The filling nozzle is additionally equipped with a filling condition sensor through which the filling sequence is terminated as soon as there is ascertained a maximum permissible liquid level. The pistol-grip filling nozzle as indicated herein is integrated into the filling device 1, and as in the preceding exemplary embodiments is again not only connected with a feed conduit 36 but also to a exhaust gas removal installation, such that also in this variant is the quantity of vented or exhaust gas which is to be removed restricted to a minimal volume.

I claim:

1. Filling device, comprising a pistol-grip filling nozzle structure including a filling pipe (4) for the manual guidance and for cooperation with a pipe connector (2) located over a filling opening (34) in a tank container (34) or suitable receptacle; a valve (24) arranged in said filling nozzle structure; a vent valve (20) and at least one connection for a flexible infeed conduit communicating with said filling pipe; and means for actuating said valve (24) and vent valve (20), said valve (24) being arranged at an outer end of the filling pipe (4) which is extendable through said pipe connector (2), said means causing said valve (24) and said vent valve (2) both to be automatically actuated in dependence upon a proper connection being formed between the filling nozzle structure and said pipe connector (2), said actuating means comprising:

(a) a first sleeve component (6) encompassing the filling pipe (4) of said filling nozzle structure and being open at the end thereof towards the pipe connector (2) and forming an attachment for the filling nozzle structure on the pipe connector (2), (b) a second sleeve component (9) coaxially encompassing said first sleeve component (6) and sealingly encompassing said filling pipe (4), (c) said sleeve components (6, 9) being axially guided sealingly slidably within each other, said second sleeve component (9) cooperating with a coupling nut (17) for axially moving the second sleeve component (9) relative to the first sleeve component (6) and for axially positioning the filling nozzle structure for connection thereof with the pipe connector (2), said coupling nut (17) cooperating with an external screwthread (19) on the pipe connector (2), (d) and an axially acting spring element being arranged between the sleeve components (6, 9) and imparting a biasing stress therebetween for maintaining the relative position of the sleeve components, whereby indication of the presence of a proper connection between the filling nozzle structure and the pipe connector (2) is derivable from the axial positions of the sleeve components (6, 9) relative to each other.

2. A filling device according to claim 1, wherein a switch (30) operatively connectable to said filling nozzle structure is automatically actuatable in dependence upon the condition of the connection between the filling device (1) and the pipe connector (2) of the filling nozzle structure for generating a signal indicative of the condition.

3. A filling device according to claim 2, wherein said switch (30) is actuatable from the relative movement between said first and second sleeve components (6, 9).

4. Filling device according to claim 2, wherein said switch (30) is arranged externally of the second sleeve component (9); and an actuating pin (29) being connected with said switch so as to be movable relative to the switch (30) in response to the relative movement between said first and second sleeve components (6, 9).

5. Filling device according to claim 1, wherein said vent valve (20) is formed from a plurality of bores (14, 22) formed in the respective sidewalls of each of the sleeve components (6, 9), said bores being movable into alignment with each other in response to a slidable connecting movement between said components.

6. Filling device according to claim 5, wherein said bores (14) in the second sleeve component (9) have a vent gas conduit (13) communicating therewith; and a flexible conduit (40) being connectable between said conduit (13) and means for removing gas.

7. Filling device according to claim 6, wherein said valve (24) is arranged in the filling nozzle structure, said valve (24) in said filling nozzle structure including a blocking member (25), an actuating rod (27) operatively connecting said valve (24) with the first sleeve component (6) such that the valve (24) in the filling nozzle structure is actuatable relative to the first sleeve component (6) responsive to the displacement of the second sleeve component (9) which retains the filling pipe (4) of said nozzle structure.

8. Filling device according to claim 1, wherein a filling condition sensor (31) for said container is fastened to the second sleeve component (9).

* * * * *

UNITED STATES PATENT AND TRADEMARK OFFICE

CERTIFICATE OF CORRECTION

PATENT NO. : 5,279,341

DATED : January 18, 1994

INVENTOR(S) : Manfred Schirmacher

It is certified that error appears in the above-indentified patent and that said Letters Patent is hereby corrected as shown below:

Column 1, line 55: "for" should read --of--

Column 1, line 63: "lien" should read --line--

Column 2, line 46: "lien" should read --line--

Column 6, line 49: after "8" insert --of--

Column 7, line 10: "basrcally" should read --basically--

Column 11, line 38, Claim 1: "(2)" should read --(20)--

Signed and Sealed this

Twenty-seventh Day of September, 1994

*Attest:*

Bruce Lehman

BRUCE LEHMAN

*Attesting Officer*

*Commissioner of Patents and Trademarks*